United States Patent [19]

Baum

[11] 4,017,480

[45] Apr. 12, 1977

[54] HIGH DENSITY COMPOSITE STRUCTURE OF HARD METALLIC MATERIAL IN A MATRIX

[75] Inventor: Charles S. Baum, St. Clair Shores, Mich.

[73] Assignee: Permanence Corporation, Detroit, Mich.

[22] Filed: Aug. 20, 1974

[21] Appl. No.: 498,994

[52] U.S. Cl. ..... 428/601; 29/182.7; 29/195; 75/240

[51] Int. Cl.[2] ..... C22C 29/00

[58] Field of Search ..... 29/191.2, 195 A, 195 M, 29/182.1, 182.7, 182.8

[56] References Cited

UNITED STATES PATENTS

| | | | |
|---|---|---|---|
| 2,806,129 | 9/1957 | Cape | 219/146 |
| 3,066,402 | 12/1962 | Ingels | 29/420.5 |
| 3,258,817 | 7/1966 | Smiley | 22/202 |
| 3,684,497 | 8/1972 | Wendler et al. | 75/203 |

*Primary Examiner*—L. Dewayne Rutledge
*Assistant Examiner*—E. L. Weise
*Attorney, Agent, or Firm*—Krass & Young

[57] ABSTRACT

To form a high density composite structure a mold is filled with relatively large particles of a hard metallic material, such as tungsten carbide; the voids between the particles are filled with substantially smaller particles of the same material and a liquid air-drying, volatile cement is poured over the particles. The filled mold is then covered with a metal brazing powder which is carried through the particle mass by the still-liquid cement. After the cement dries the part is heated in a controlled atmosphere furnace to a temperature above the melting point of the metal powder, and below the melting point of the particle material driving off the cement and causing the balance of the brazing powder to melt and infiltrate the particles to form a composite with a high density of the hard particles embedded in a matrix of the brazing metal. The mold may become brazed to the matrix to form a permanent part of the final structure or may be separable from the matrix after brazing. Cast metal products containing the high density composite matrixes as inserts are also disclosed.

4 Claims, 6 Drawing Figures

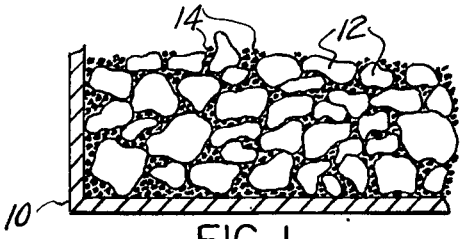
FIG. 1
FIG. 2
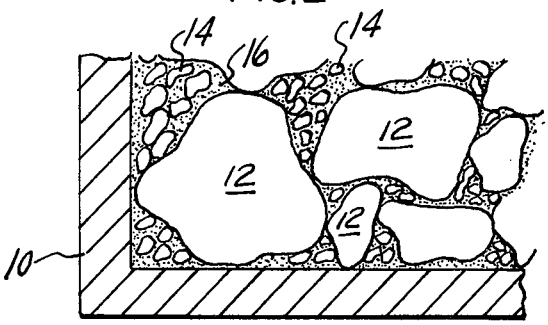
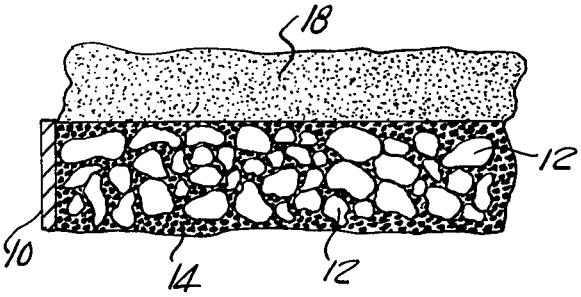
FIG. 3
FIG. 4
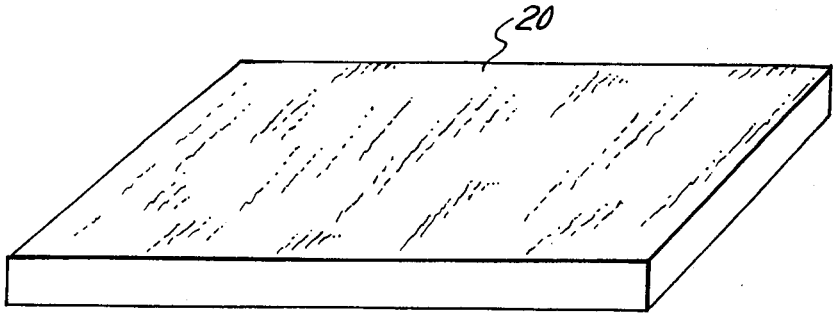
FIG. 5
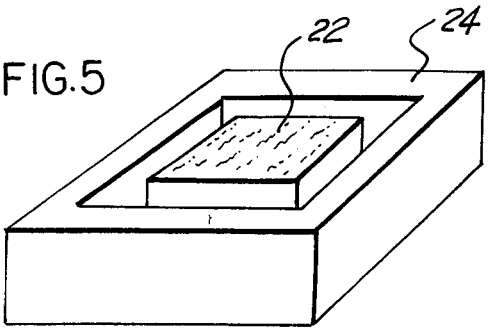
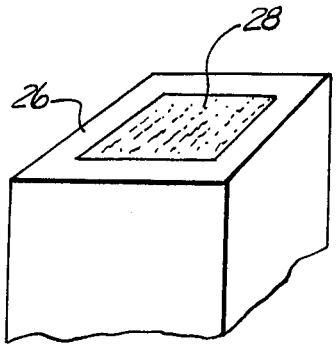
FIG. 6

HIGH DENSITY COMPOSITE STRUCTURE OF HARD METALLIC MATERIAL IN A MATRIX

BACKGROUND OF THE INVENTION

1. Field of the Invention

The present invention relates generally to a composite structure comprising a high density of hard metallic particles, such as tungsten carbide, uniformly disposed within a matrix of a softer brazing metal or alloy and to a method of making the same.

2. Prior Art

In order to form a material which combines the excellent wear resistance of hard materials such as metal oxides, silicides, borides and carbides with the ductility of softer metals, composite materials have been devised consisting of the soft material. For example, U.S. Pat. 3,684,497 discloses a class of composite materials which includes tungsten carbide particles disposed in a matrix of a copper alloy. That patent suggests such a composite has utility in heat resistant and drill proof armor plates for safe or vault protection as well as in high wear applications. The hard particles provide the necessary resistance to wear and to penetration while the softer, more thermally conductive matrix provides torch protection and gives the composite material a toughness which substantially exceeds that of the hardened material.

The relative percentages of the hard particles and the soft matrix will vary as a function of the application but in most applications it is desirable that the hard particles predominate and the matrixing material be present in only sufficient quantity to firmly bond the hard particles into the composite. The aforementioned patent discloses one prior art method of achieving this high density of hard particles in the soft matrix involving packing a mold with particles of a relatively large average particle size and a sufficient amount of softer metal, in powder form, to coat the hard particles an bind them into a unitary, porous skeleton, when the mold is placed in a brazing furnace. This skeleton is then coated with a mixture of hard particles of substantially smaller average particle size and further alloy powder and passed through the furnace a second time. The finer particles tend to infiltrate the skeleton of the larger particles with the flow of the molten alloy powder to increase the density of hard particles in the resulting structure. By use of this method I have been able to achieve structures wherein the hard particles represent about 60% by volume of the finished product. In certain wear applications this density has proved inadequate and the relatively high proportion of softer materials has caused surface erosion which severely curtails the life of wear resistant parts formed by this process.

SUMMARY OF THE INVENTION

The present invention is directed to a composite structure including a high density of hard particles bonded together in a softer matrixing metal, and to a method of making the same. The product consists of hardened particles of two distinct average sizes closely and intimately packed together and bonded together by the softer matrixing alloy. One primary distinction between the product structure and that of the patent referred to above is the fact that the smaller average size particles fill the voids between the larger size particles much more fully in the present structue than they did in products formed by the previous technique. This dense structure results from the process of filling the voids between the larger particles before the voids are locked into a rigid skeleton.

In certain embodiments of my invention, which will be hereinafter described in detail, the structure also includes a steel plate which is used as a mold in forming the material; becomes bonded to the matrix at the same time as the hardened particles; and provides the structure with a tensile and bending strength not available in a body consisting solely of the particles and the bonding matrix.

The method of forming the present composite material involves first filling a mold, which may be formed of steel so as to form a permanent part of the resultant structure, or may be inert so as to be separable from the matrix, with hardened particles of a relatively large average size. For example, these particles may be small enough to pass through a 16 strand per inch mesh and too large to pass through an 8 strand per inch mesh (8–16 grit). The loose network of particles thus formed is then filled with substantially finer particles by simply laying the finer particles on the exposed surface of the large particles and manually working the small particles into the mass of large particles. The mass may also be manually or machine vibrated to assist the infiltration of the small particles into the large particles. Small particles must have an average size which is no greater than ⅓ the average size of the large particles. For example, using 8–16 large particles we preferably use small particles of minus 100 particle size. (These particles are small enough to pass through a 100 strand per inch mesh.) Since the large particles are free to displace slightly to make room for the small particles, the voids between the large particles are filled to a much greater degree by this process than they are by the process of infiltrating a fixed skeleton of relatively large particles with the finer particles as was done in the prior art.

The present method further contemplates filling the resultant loose mass of relatively large particles infiltrated with relatively small particles with a liquid brazing cement which uniformly coats al of the particles. The mixture is then covered with a powered matrixing metal.

The mixture is then covered with powdered matrixing metal before the brazing cement dries. The liquid brazing cement tends to draw the fine metal powder down into the voids in the mass of particles. Some portion of the powdered metal remains on the exposed upper surface of the particle mass.

After the liquid brazing cement has dried, the particle loaded tray with its powdered metal topping is heated in a controlled atmosphere brazing furnace to the brazing temperature of the metal alloy. As the powdered metal melts it continues the infiltration of the particle mass, filling the voids in the skeleton and forming a solid product. The hardened brazing cement volatilizes at a temperature below the brazing temperature of the metal alloy leaving the structure completely free of residue. When a steel tray is used as the mold the tray is simultaneously brazed to the particulate mass.

The resultant product has a substantially higher density of hardened particles than products produced by prior art processes and exhibits much higher resistance to abrasion than the prior art structures. It is accordingly ideally suited for environments that are subjected to constant wearing forces.

The present invention further contemplates metal parts formed with inserts made of the present composite material. These may be achieved by placing structures of the composite materials as inserts in molds used to case the metallic objects. For example, digging teeth for mining machines are suitably formed by this process.

The composite structures formed in accordance with the present invention therefore have a content of hardened particles which exceeds the percentages attainable using methods of the prior art, bonded together by a high strength soft heat conductive matrix. I have been able to form structures wherein the hard particles form over 80% of the volume of the composite. The surface properties of the composite are such as to provide it with extremely high wear resistance resulting from the hardness of the particles and the ductility of the matrix. In those embodiments wherein the particle mass is reinforced with a steel tray or with the metal of a part in which the particle mass is an insert, the composite is provided with the resistance to bending and tensile forces afforded by the underlying metal.

Other objects, advantages and applications of the present invention will be made apparent by the following detailed description.

The description makes reference to the accompanying drawings in which:

FIG. 1 is a sectional view through the corner of a mold packed with the loose structure of hard particles as one step in the formation of the product of the present invention;

FIG. 2 is a more enlarged cross-sectional view through one corner of the mold when the loose particle mass has been filled with a liquid brazing cement;

FIG. 3 is a veiw similar to FIG. 2 showing the further addition of a metal brazing powder on the exposed surface of the particle mass;

FIG. 4 is a perspective view illustrating the composite product formed in accordance with one embodiment of the invention;

FIG. 5 is a perspective view of one-half of a mold for forming a cast metal article with a composite pad formed in accordance with the present invention as an insert therein; and FIG. 6 is a perspective view of a portion of a digger tooth having a pad formed in accordance with the present invention formed as an insert therein.

As has been previously stated, the products formed in accordance with the present invention may be divided into a first class, wherein a particle mass is supported and reinforced by a metallic member, which may be either a tray, or a section of some operating element, but which is either event lends tensile and bending resistance to the composite structure; or a second class of composite structure consisting simply of the hardened particles and the interlocking softer matrix. These unsupported products may be used in a variety of applications such as attack resistant liners for safes or vaults.

In either event, the process of manufacture of the composite begins with the filling of a void in a tray, which is to become an integral part of the composite, such as the tray 10 of FIGS. 1–4, or an equivalent mold which is to be removed from the finished composite and is formed of a relatively inert material such as "glass-rock", alumina or a like material.

The tray or mold 10 is first completely filled with a mass of relatively large hard particles 12. In the preferred embodiment of the invention, these particles 12 consist of a sintered or cemented tungsten carbide grit which is formed by crushing either virgin sintered tungsten carbide or sintered tungsten carbide recovered from scrap cutting tools. Alternatively, other hard material particles such as hard metal alloys, metal oxides, borides or silicides may be employed.

The relatively large size grit 12 preferably has a particle size of 8/16, or minus 8 to plus 16 (U.S. Mesh Size Standard). Such particle size range consists of particles that are capable of passing through a No. 8 mesh size sieve, but which are retained by a No. 16 mesh size sieve. In other embodiments of the invention, other ranges of large particle sizes may be employed such as 6/20 or 4/2.

The large particles 12 filling the mold or tray 10 are then infiltrated with a mass of smaller particles 14, preferably formed of the same hard material as the particles 12, but having a substantially smaller particle size. Preferably, when the large particles 12 have an 8/16 size distribution, the particles 14 will have a minus 100 particle size distribution, that is, they will be particles that pass through a 100 mesh screen. The ratio between the average size of the particles 12 and the average size of the particles 14 must be at least 3:1, but it is preferably 5:1 or 6:1. Accordingly, the smaller particles 14 fill the voids formed between the larger particles 12.

Preferably, a layer of the smaller particles is placed over an exposed surface of the coarse particles 12 and manually pressed so as to force the small particles in between the larger particles. During this process the larger particles separate and move slightly so as to accommodate the smaller particles and I believe that it is this freedom of movement which allows the more complete filling of the large particle skeleton than was possible with the previous process wherein the skeleton was cemented into a rigid structure with a coating of a matrixing alloy before the small particles infiltrated the skeleton.

The mold or tray 10 may be manually or machine vibrated to assist in the penetration of the fine particles 14 into the mass of coarser particles 12 but I have generally found that a manual packing process is more effective than any mechanized process.

The resultant structure consisting of the loose particles or large grit 12 with the voids between those particles substantially filled with the grains of finer particles 14, is illustrated in FIG. 1.

The loose particle structure is then filled with a liquid brazing cement 16. I preferably employ Nicrobraze 500 manufactured by the Wall Colmonoy Corporation of Detroit which constitutes a plastic binder in a volatile base. The liquid readily fills the space between the particles 12 and 14 as illustrated in FIG. 2.

After the grit mass is filled with the liquid brazing cement 16, and before the brazing cement has dried, the exposed upper surface of the grit structure is covered with a powdered brazing metal 18 which has a lower melting temperature than the hard particles 12 and 14. The brazing powder would preferably be of a ductile metal of alloy. In the preferred embodiment an AMI 100 nickel braze is used which is made by Alloy Metal, Inc., and having the following approximate composition:

Chromium — 19.0%
Iron — 3.0%
Manganese — 0.5%
Silicon — 10.0%

Cobalt — 0.5%
Carbon — 15.0%
Nickel — Balance

The brazing point of such alloy is in the neighborhood of 2100° F to 2175° F (1150° to 1190° C). Other convenient nickel brazes are NB 150 and NB 160 sold by Wall Colmonoy Corporation.

NB 150 braze has a composition of:
Chromium — 15.0%
Boron — 3.5%
Nickel — Balance NB 160 braze has a composition of:
Chromium — 11.0%
Iron — 3.5%
Boron — 2.5%
Silicon — 3.5%
Carbon — 0.5%
Nickel — Balance The convenient braze temperature for NB 150 is in the range of 1950° to 2200° F (1065° to 1200° C) and the brazing temperature of NB 160 is in the range of 2100° to 2200° F (1150° to 1200° C). It has also been found that copper powder is also a convenient brazing material. The brazing temperature range of copper is in the range of 2000° to 2100° F (1100° to 1150° C).

This powdered alloy, in very fine form, is used to cover the exposed surface of the carbide grit. The liquid brazing cement tends to draw the fine powder through the voids in the grit structure. The primary purpose of the cement is to thus enhance the penetration of the structure with the powdered metal alloy.

The larger part of the powdered metal however does not infiltrate the particle mass but remains on its surface.

The particle mass covered with powder is allowed to sit at room temperature until the cement hardens; typically about 1 hour. It is then placed in a controlled atmosphere furnace, preferably a hydrogen furnace, for about 20 minutes and is heated to the brazing point of the alloy. At a point below the brazing temperature, the dried brazing cement will vaporize. As the brazed temperature is approached the powdered metal will begin to melt and will permeate the grit mass. If a smooth surface is desired on the mass an inert mold cover may be placed over the powder. The surface will then conform to the texture and contour of this cover.

After heating for about 20 minutes the furnace is allowed to cool to about 300° F and then the completed mold is removed.

If a part is heated in a tray 10 which is to be part of the finished product, the tray will have been brazed to the grit mass in the furnace. Otherwise, the particle mass is removed from the mold 10.

A completed composite pad 20, formed in a tray 10, is shown in FIG. 4.

A composite pad 22, preferably formed from a removable mold, may be used as an insert in a mold half 24, illustrated in FIG. 5, for the formation of a cast metal part having a composite insert formed in accordance with the present invention. For example, the digger tooth 26 illustrated in FIG. 6 has an insert 28 that is formed of sintered tungsten carbide particles bonded together in accordance with the teachings of the present invention. The metal of the casting 26 which surrounds the pad 28 on five of its sides acts to provide the pad with the necessary tensile and bending strength.

The embodiments of the invention, in which an exlusive property or privilege is claimed are defined as follows:

1. A wear resistant plate comprising: a substantially uniform dispersion of a plurality of irregularly shaped particles of a relatively large average size produced by crushing sintered tungsten carbide and a plurality of irregularly shaped particles of sintered tungsten carbide of a substantially smaller average size disposed within and substantially filling the interstices of the larger particles, said particles being bonded within a matrix of a metal having a lower melting point than said particles.

2. The plate of claim 1 wherein said matrixing material consists of a copper alloy.

3. The plate of claim 1 wherein the average size of the large particles is at least three times greater than the average size of the smaller particles.

4. The plate of claim 1 further including an integral steel mold having a melting point higher than said matrixing material which leaves one surface of the particle mass exposed.

* * * * *

UNITED STATES PATENT OFFICE

CERTIFICATE OF CORRECTION

Patent No. 4,017,480 Dated April 12, 1977

Inventor(s) Charles S. Baum

It is certified that error appears in the above-identified patent and that said Letters Patent are hereby corrected as shown below:

Column 1, line 65 "product" should be --present--; line 68 "structue" should be --structure--.

Column 2, line 43 "al" should be --all--; line 44 "powered" should be --powdered--.

Column 3, line 35 "veiw" should be --view--; line 53 "is" should be --in--; line 55 "structure" should be --structures--.

Column 4, line 14 "4/2" should be --4/12--; line 61 "of" should be --or--.

Column 6, line 24 "exlu-" should be --exclu- --.

Signed and Sealed this

*ninth* Day of *August 1977*

[SEAL]

*Attest:*

RUTH C. MASON
*Attesting Officer*

C. MARSHALL DANN
*Commissioner of Patents and Trademarks*